US007361629B2

(12) United States Patent
Loper et al.

(10) Patent No.: US 7,361,629 B2
(45) Date of Patent: Apr. 22, 2008

(54) ADDITIVES FOR LUBRICANTS AND FUELS

(75) Inventors: John T. Loper, Richmond, VA (US); Paul G. Griffin, Glen Allen, VA (US); David A. Hutchison, Powhatan, VA (US); Robert T. Dittmeier, Richmond, VA (US)

(73) Assignee: Afton Chemical Corporation, Richmond, VA (US)

( * ) Notice: Subject to any disclaimer, the term of this patent is extended or adjusted under 35 U.S.C. 154(b) by 495 days.

(21) Appl. No.: 10/797,877

(22) Filed: Mar. 10, 2004

(65) Prior Publication Data

US 2005/0202980 A1 Sep. 15, 2005

(51) Int. Cl.
*C10M 133/56* (2006.01)
*C10M 129/86* (2006.01)

(52) U.S. Cl. ..... 508/291; 508/293; 508/232

(58) Field of Classification Search ..... 508/232, 508/291, 293
See application file for complete search history.

(56) References Cited

U.S. PATENT DOCUMENTS

| | | | | |
|---|---|---|---|---|
| 2,749,311 | A | | 6/1956 | Sabol et al. |
| 2,760,933 | A | | 8/1956 | Fields et al. |
| 2,765,289 | A | | 10/1956 | Fields et al. |
| 2,850,453 | A | | 9/1958 | Fields |
| 2,910,439 | A | | 10/1959 | Fields |
| 3,172,892 | A | | 3/1965 | LeSuer et al. |
| 3,219,666 | A | | 11/1965 | Norman et al. |
| 3,235,498 | A | | 2/1966 | Waldmann |
| 3,235,499 | A | | 2/1966 | Waldmann |
| 3,235,502 | A | | 2/1966 | Waldmann |
| 3,272,746 | A | | 9/1966 | LeSuer et al. |
| 3,361,673 | A | | 1/1968 | Stuart et al. |
| 3,663,561 | A | | 5/1972 | Blaha |
| 3,676,089 | A | | 7/1972 | Morris et al. |
| 3,840,549 | A | | 10/1974 | Blaha et al. |
| 3,862,798 | A | | 1/1975 | Hopkins |
| 3,974,081 | A | | 8/1976 | Rutkowski et al. |
| 4,029,587 | A | | 6/1977 | Koch |
| 4,092,255 | A | | 5/1978 | Chapelet et al. |
| 4,146,489 | A | | 3/1979 | Stambaugh et al. |
| 4,170,561 | A | | 10/1979 | Chapelet et al. |
| 4,234,435 | A | | 11/1980 | Meinhardt et al. |
| 4,444,654 | A | | 4/1984 | Cargle et al. |
| 4,614,593 | A | | 9/1986 | Roark |
| 4,686,054 | A | | 8/1987 | Wisotsky et al. |
| 4,715,975 | A | | 12/1987 | Kapusciniski et al. |
| 4,732,942 | A | | 3/1988 | Liu et al. |
| 4,769,043 | A | | 9/1988 | Kapusciniski et al. |
| 4,810,754 | A | | 3/1989 | McCrary |
| 4,857,214 | A | | 8/1989 | Papay et al. |
| 4,863,623 | A | | 9/1989 | Nalesnik |
| 4,873,009 | A | | 10/1989 | Anderson |
| 5,062,980 | A | * | 11/1991 | Migdal et al. ..... 508/291 |
| 5,071,919 | A | | 12/1991 | DeGonia et al. |
| 5,075,383 | A | | 12/1991 | Migdal et al. |
| 5,080,815 | A | | 1/1992 | Fenoglio et al. |
| 5,112,508 | A | | 5/1992 | DeRosa et al. |
| 5,137,980 | A | * | 8/1992 | DeGonia et al. ..... 525/327.6 |
| 5,230,714 | A | | 7/1993 | Steckel |
| 5,238,588 | A | | 8/1993 | Nalesnik et al. |
| 5,242,613 | A | | 9/1993 | Ozbalik et al. |
| 5,294,354 | A | | 3/1994 | Papke et al. |
| 5,344,579 | A | | 9/1994 | Ohtani et al. |
| 5,372,735 | A | | 12/1994 | Ohtani et al. |
| 5,393,309 | A | | 2/1995 | Cherpeck |
| 5,441,656 | A | | 8/1995 | Ohtani et al. |
| 5,454,964 | A | | 10/1995 | Blackborow et al. |
| 5,523,008 | A | | 6/1996 | Boden et al. |
| 5,559,265 | A | | 9/1996 | Love et al. |
| 5,620,486 | A | | 4/1997 | Cherpeck |
| 5,663,126 | A | | 9/1997 | Boden et al. |
| 5,814,111 | A | * | 9/1998 | Graham et al. ..... 44/443 |
| 5,814,586 | A | | 9/1998 | Boden et al. |
| 5,888,947 | A | * | 3/1999 | Lambert et al. ..... 508/491 |
| 6,001,786 | A | | 12/1999 | Gatto et al. |
| 6,096,691 | A | | 8/2000 | Conary et al. |
| 6,096,695 | A | | 8/2000 | Lem et al. |
| 6,107,257 | A | | 8/2000 | Valcho et al. |
| 6,107,258 | A | * | 8/2000 | Esche et al. ..... 508/231 |
| 6,117,825 | A | | 9/2000 | Liu et al. |
| 6,133,206 | A | | 10/2000 | Gracey et al. |
| 6,133,210 | A | * | 10/2000 | Tipton ..... 508/469 |
| 6,187,721 | B1 | | 2/2001 | Goldblatt et al. |
| 6,427,647 | B1 | * | 8/2002 | Galka et al. ..... 123/73 B |
| 6,599,865 | B1 | | 7/2003 | Esche, Jr. et al. |
| 2002/0147116 | A1 | * | 10/2002 | Carrick et al. ..... 508/198 |

FOREIGN PATENT DOCUMENTS

| | | |
|---|---|---|
| EP | 0 909 805 A1 | 4/1999 |
| EP | 1 318 188 A1 | 6/2003 |

* cited by examiner

*Primary Examiner*—Glenn Caldarola
*Assistant Examiner*—James Goloboy
(74) *Attorney, Agent, or Firm*—Fitch, Even, Tabin & Flannery

(57) ABSTRACT

A multi-functional composition for use as an additive for fuels and lubricants. The composition includes an amination product of a hydrocarbyl substituted succinic acylating agent and a mixture containing an aliphatic polyamine and an aromatic polyamine. The molar ratio of aliphatic polyamine to aromatic polyamine in the mixture ranges from about 10:0.1 to about 0.1:10. The amination product contains at least about 0.1 molar equivalent of the polyamine mixture to 1 molar equivalent of the hydrocarbyl substituted succinic acylating agent.

6 Claims, No Drawings

ADDITIVES FOR LUBRICANTS AND FUELS

TECHNICAL FIELD

The following disclosure is directed to additives for fuel and/or lubricant compositions and, in particular, to novel additives derived from acylating compounds and mixtures of aliphatic and aromatic polyamines.

BACKGROUND

Chemical compositions are added to fuels and lubricants to control the physical and chemical properties of the fuel and lubricant compositions and to improve engine performance. Such additives include dispersants, antioxidants, viscosity index modifiers, corrosion inhibitors, wear reducing agents, extreme pressure agents, and the like. Dispersants are particularly important additives for lubricant and fuel compositions. Dispersants maintain impurities and deposits in a suspended state so that they can be removed from the system by filtration or other means rather than being deposited on internal engine components.

Of the dispersants commonly used in lubricant and fuel applications, polymeric Mannich base additives, hydrocarbyl amine adducts, and hydrocarbyl succinic acid derivatives exhibit desired properties for such applications. Mannich base dispersants are typically produced by reacting alkyl-substituted phenols with aldehydes and amines.

Hydrocarbyl succinic acid based dispersants are derived by alkylating, for example, maleic anhydride, acid, ester or halide with an olefinic hydrocarbon to form an acylating agent as described in U.S. Pat. No. 5,071,919 to DeGonia et al. The acylating agent is then reacted with an amine, typically a polyalkylene amine or polyamine to form a dispersant, such as described in U.S. Pat. Nos. 3,219,666; 3,272,746; 4,234,435; 4,873,009: 4,908,147; and 5,080,815.

Despite the wide variety of additives available for lubricant and fuel applications, there remains a need for improved additives to provide increased deposit control and dispersancy without incurring a cost disadvantage.

SUMMARY OF THE EMBODIMENTS

In one embodiment herein is presented a multi-functional composition for use as an additive for fuels and lubricants. The composition includes an amination product of a hydrocarbyl substituted succinic acylating agent and a mixture containing an aliphatic polyamine and an aromatic polyamine. The molar ratio of aliphatic polyamine to aromatic polyamine in the mixture ranges from about 10:0.1 to about 0.1:10. The amination product contains at least about 0.1 molar equivalent of the aromatic polyamine to 1 molar equivalent of the hydrocarbyl substituted succinic acylating agent.

In another embodiment there is provided a method for making a novel amination product for use as an additive for fuels and lubricants. The amination product has combined dispersant and antioxidant functionality. The method includes providing a hydrocarbyl substituted succinic acylating agent to a reaction vessel. The acylating agent is then heated to an elevated temperature above room temperature. An aromatic polyamine is dissolved in an aliphatic polyamine to provide an amine mixture. The molar ratio of aliphatic polyamine to aromatic polyamine in the mixture ranges from about 10:0.1 to about 0.1:10. The amine mixture is reacted with the heated acylating agent under an inert atmosphere to provide the novel amination product. The amination product contains at least about 0.1 molar equivalent of the aromatic polyamine to 1 molar equivalent of the hydrocarbyl substituted succinic acylating agent In yet another embodiment, a method of lubricating moving parts of a vehicle is provided. The method includes using as a lubricating oil for one or more moving parts of the vehicle a lubricant composition containing a lubricant and a lubricant additive. The lubricant additive includes an amination product of a hydrocarbyl substituted succinic acylating agent and a mixture containing an aliphatic polyamine and an aromatic polyamine. The molar ratio of aliphatic polyamine to aromatic polyamine in the mixture ranges from about 10:0.1 to about 0.1:10. The amination product contains at least about 0.1 molar equivalent of the aromatic polyamine to 1 molar equivalent of the hydrocarbyl substituted succinic acylating agent.

An advantage of the embodiments described herein is that it provides novel additives that exhibit multifunctional properties with respect to fuel and lubricant compositions containing the additives. For example, the additives not only exhibit improved dispersancy properties, but also exhibit antioxidant properties thereby reducing or eliminating the need to provide separate antioxidant additives for use in the lubricant and fuel compositions. Another advantage of the invention is that a simplified process may be used to make the multifunctional additive composition. For example, the process is preferably conducted in the substantial absence of a surfactant. Accordingly, purification of the product does not require removal of components that do not exhibit the desired properties.

The novel compositions described herein are suitable for crankcase lubricants for diesel and gasoline engines, as a dispersant for automatic transmission fluids, as an additive for continuously variable gear oils, as a component of hydraulic oils, as an additive for gasoline and diesel powered engines. Other features and advantages of the additive will be evident by reference to the following detailed description which is intended to exemplify aspects of the preferred embodiments without intending to limit the embodiments described herein.

DETAILED DESCRIPTION OF THE PREFERRED EMBODIMENTS

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having a predominantly hydrocarbon character.

Examples of hydrocarbyl groups include:

(1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical);

(2) substituted hydrocarbon substituents, that is, substituents containing non-hydrocarbon groups which, in the context of the description herein, do not alter the predominantly hydrocarbon substituent (e.g., halo (especially chloro and fluoro), hydroxy, alkoxy, mercapto, alkylmercapto, nitro, nitroso, and sulfoxy);

(3) hetero-substituents, that is, substituents which, while having a predominantly hydrocarbon character, in the context of this description, contain other than carbon in a ring or chain otherwise composed of carbon atoms. Hetero-atoms include sulfur, oxygen, nitrogen, and encompass substituents such as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

Of the hydrocarbyl substituents, olefinic hydrocarbons are particularly preferred for the hydrocarbyl substituent. Olefinic hydrocarbons such as isobutene are typically made by cracking a hydrocarbon stream to produce a hydrocarbon mixture of essentially $C_4$-hydrocarbons. For example, thermocracking processes (streamcracker) produce $C_4$ cuts comprising $C_4$ paraffins and $C_4$ olefins, with a major component being isobutene. Polymerization of isobutene by well known processes provides a hydrocarbyl substituent having a desired molecular weight for the compositions described herein.

A first component of the reaction mixture used to prepare novel additive compositions as described herein is a hydrocarbyl-substituted acylating agent. When reacted with amines, hydrocarbyl-substituted acylating agents typically provide imide reaction products. The imide reaction products may be mono-imide products or bis-imide products. The hydrocarbyl-substituted acylating agents include, but are not limited to, hydrocarbyl-substituted succinic acids, hydrocarbyl-substituted succinic anhydrides, the hydrocarbyl-substituted succinic acid halides (especially the acid fluorides and acid chlorides), and the esters of the hydrocarbyl-substituted succinic acids and lower alcohols (e.g., those containing up to 7 carbon atoms), that is, hydrocarbyl-substituted compounds which can function as carboxylic acylating agents. Of these compounds, the hydrocarbyl-substituted succinic acids and the hydrocarbyl-substituted succinic anhydrides and mixtures of such acids and anhydrides are generally preferred, the hydrocarbyl-substituted succinic anhydrides being particularly preferred.

Hydrocarbyl substituted acylating agents are made by well known techniques, such as by the reaction of maleic anhydride with the desired polyolefin or chlorinated polyolefin, under reaction conditions well known in the art. For example, such succinic anhydrides may be prepared by the thermal reaction of a polyolefin and maleic anhydride, as described in U.S. Pat. Nos. 3,361,673; 3,676,089; and 5,454,964. Alternatively, the substituted succinic anhydrides may be prepared by the reaction of chlorinated polyolefins with maleic anhydride, as described, for example, in U.S. Pat. No. 3,172,892. A further discussion of hydrocarbyl-substituted succinic anhydrides can be found, for example, in U.S. Pat. Nos. 4,234,435; 5,230,714; 5,620,486 and 5,393,309. Typically, these hydrocarbyl-substituents will contain from 40 to 500 carbon atoms.

The mole ratio of maleic anhydride to olefin can vary widely. For example, the mole ratio may vary from 10:1 to 1:5, with a more preferred range of 1:1 to 6:1, with olefins such as polyisobutylene having a number average molecular weight of 100 to 7000, preferably 300 to 5000 or higher. The maleic anhydride is preferably used in stoichiometric excess, e.g. 1.1 to 3 moles maleic anhydride per mole of olefin. The unreacted maleic anhydride can be vaporized from the resultant reaction mixture.

Olefin substituted maleic anhydride may be represented by the structure:

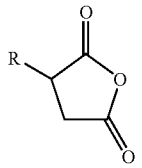

wherein R comprises a hydrocarbyl group having a number average molecular weight as determined by gel permeation chromatography ranging from about 200 to about 10,000. For lubricant additives, the number molecular weight of the hydrocarbyl group preferably ranges from about 300 to about 5000, whereas for fuel additives, the molecular weight of the hydrocarbyl group preferably ranges from about 200 to about 1000. A particularly preferred olefin substituted maleic anhydride, or acid is polyisobutylene (PIB) succinic anhydride or acid (PIBSA), wherein the PIB is a linear or branched polyisobutylene.

In one embodiment, the polyisobutylene employed is a polyisobutylene having a high methylvinylidene isomer content, that is, at least about 70% methylvinylidene. Suitable high methylvinylidene polyisobutylenes include those prepared using boron trifluoride catalysts. The preparation of such polyisobutylenes in which the methylvinylidene isomer comprises a high percentage of the total olefin composition is described in U.S. Pat. Nos. 4,152,499 and 4,605,808, the disclosures of each of which are incorporated herein by reference. Examples of such polyisobutylenes having a high methylvinylidene content include Ultravis 10, a polyisobutylene having a molecular weight of about 950 and a methylvinylidene content of about 76%, and Ultravis 30, a polyisobutylene having a molecular weight of about 1300 and a methylvinylidene content of about 74%, both available from British Petroleum.

The other important component of the reaction mixture to produce novel additive products as described herein is the amine component. The amine component is preferably a mixture of aliphatic linear or branched polyamines and aromatic polyamines. The polyamines reacted with the hydrocarbyl-substituted acylating agent preferably include at least one primary or secondary amino group. A terminal primary amino group is particularly preferred.

The aliphatic polyamines include, but are not limited to the following: aminoguanidine bicarbonate (AGBC), diethylene triamine (DETA), triethylene tetramine (TETA), tetraethylene pentamine (TEPA), pentaethylene hexamine (PEHA) and heavy polyamines. A heavy polyamine is a mixture of polyalkylenepolyamines comprising small amounts of lower polyamine oligomers such as TEPA and PEHA but primarily oligomers with 7 or more nitrogen atoms, 2 or more primary amines per molecule, and more extensive branching than conventional polyamine mixtures.

Aromatic polyamines that are mixed with the aliphatic polyamines can include, but are not limited to, N-arylphenylenediamines such as N-phenylphenylene-diamines, for example, N-phenyl-1,4-phenylenediamine (also referred to as NPPDA), N-phenyl-1,3-phenylenedi-amine, and N-phenyl-1,2-phenylenediamine and substituted aromatic polyamines of the structure:

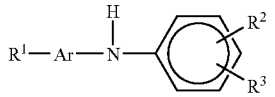

wherein Ar is an aromatic group, $R^1$ is selected from the group consisting of H, —$NH_2$, —NH-aryl-$NH_2$, —NH-aryl-alkyl-$NH_2$, —NH-alkyl-$NH_2$, —NH-aryl, —NH-aryl-alkyl, —NH-alkyl, or a branched or straight chain radical having 4 to 24 carbon atoms that can be alkyl, alkenyl, alkoxy, arylalkyl, hydroxyalkyl, and aminoalkyl, $R^2$ is selected from the group consisting of —$NH_2$, —$NH(CH_2)_n)_mNH_2$, —$CH_2$—$(CH_2)_n$—$NH_2$, and -aryl-$NH_2$, in which n and m have a value of from 1 to 10, and $R^3$ is selected from the group consisting of —H, alkyl, alkenyl, alkoxy, arylalkyl, and alkaryl having 4 to 24 carbon atoms. In one embodiment, only one of $R^2$ and $R^3$ has a terminal $NH_2$ group.

In one embodiment the aromatic polyamine component is contacted with or can even be substantially dissolved in the aliphatic polyamine component prior to reaction with the hydrocarbyl-substituted acylating agent, however a mixture of aliphatic and aromatic polyamines in a suitable solvent may also be used. The mixture preferably contains a major amount of aliphatic polyamine. Hence, the aliphatic polyamine is present in the mixture in an amount that ranges from about 0.5 to about 100 times the amount of aromatic polyamine based on mole equivalents of the aliphatic and aromatic polyamine components. The molar ratio of aliphatic polyamine to aromatic polyamine in the mixture in another embodiment can range from about 10:1 to about 1:10. In yet another embodiment the molar ratio can range from 10:0.1 to about 2:3. The acylating agent to total amine molar ratio may range from about 1:1 to about 6:1.

In order to form novel amination products, the hydrocarbyl-substituted acylating agent is provided in a reaction vessel under an inert atmosphere, such as nitrogen or argon. The acylating agent is then heated to an elevated temperature above room temperature, for example, from about 70° to about 180° C. The amine mixture described above is then added to the reaction vessel while maintaining the inert atmosphere. It is preferred that the molar ratio of acylating agent to amino groups in the mixture range from about 1:1 to about 6:1. After combining the amine mixture and the acylating agent, the reactants are stirred at a temperature ranging from about 70° to about 180° C. for a period of time sufficient to substantially react all of the components, for example, for about 2 to about 6 hours or longer. The reaction product is then diluted with a process oil, cooled to room temperature and filtered. An important feature of the reaction process is that the reaction is conducted in the substantial absence of surfactants.

Without desiring to be bound by theory, it is believed that the aliphatic amine component of the reaction mixture reacts with the anhydride to open the ring structure of the succinic anhydride and provide a reactive site for the aromatic amine component. Depending on the molar ratio of the reactants used, a combination of amination products may be obtained. The products may be represented by the following structure:

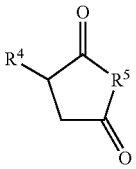

wherein $R^4$ is selected from the group consisting of linear and branched polyolefins and substituted olefins wherein the substituent of the substituted olefins can in one embodiment have the structure:

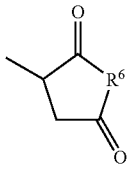

wherein $R^5$ is selected from one or more linear or branched aliphatic polyamines, aromatic polyamino group derived from N-phenyl-1,4-phenylenediamine, N-phenyl-1,3-phenylenediamine, and N-phenyl-1,2-phenylenediamine, and mixtures thereof and substituted aromatic polyamines of the structure:

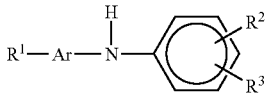

wherein $R^1$, $R^2$, and $R^3$ are defined above, and substituted linear or branched aliphatic polyamines, wherein the substituent is selected from H, a hydrocarbyl-substituted succinic anhydride group, an amido acid group, and a diamido group, and wherein $R^6$ is selected from one or more linear or branched aliphatic polyamines, aromatic polyamino group derived from N-phenyl-1,4-phenylenediamine, N-phenyl-1,3-phenylenediamine, and N-phenyl-1,2-phenylenediamine, and mixtures thereof and substituted aromatic polyamines of the structure:

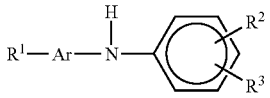

wherein $R^1$, $R^2$, and $R^3$ are defined above. Accordingly, in one embodiment the amination reaction product can comprise one or more of the following compounds:

(a) succinimides of the structure:

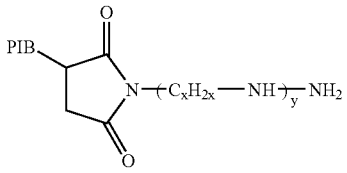

(b) bis-succinimides of the structure

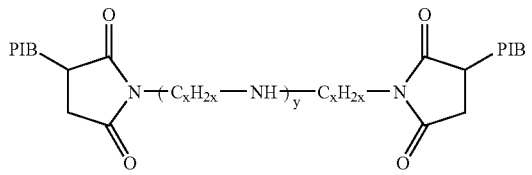

wherein x is an integer ranging from 1 to 6, and y is an integer ranging from 1 to 10, and PIB is a linear or branched polyisobutylene group;

(c) aromatic imides of the structure:

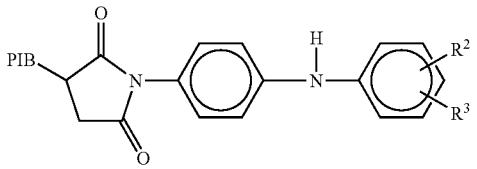

wherein $R^2$ and $R^3$ are as defined above;

(d) bis-succinimide-amides of the structure:

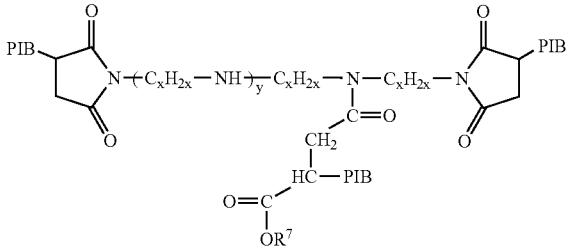

wherein $R^7$ is selected from the group consisting of H, amine salt, and a metal salt, (e) bis-succinimide-di-amide amines of the structure:

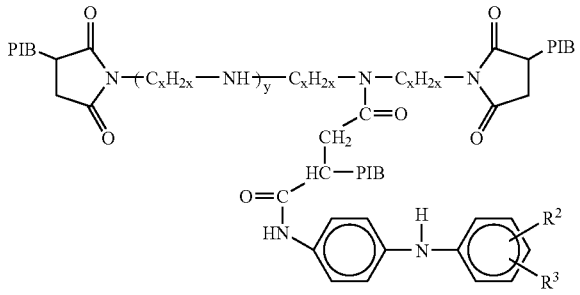

wherein PIB, x, y, $R^2$ and $R^3$ are as defined above;

(f) bis-succinimides containing an amide-amine substituted olefin of the structure:

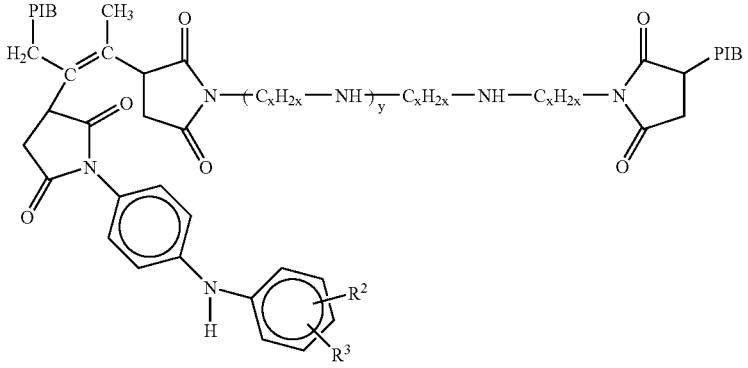

(g) bis-succinimide-amides containing an amide-amine substituted olefin of the structure:

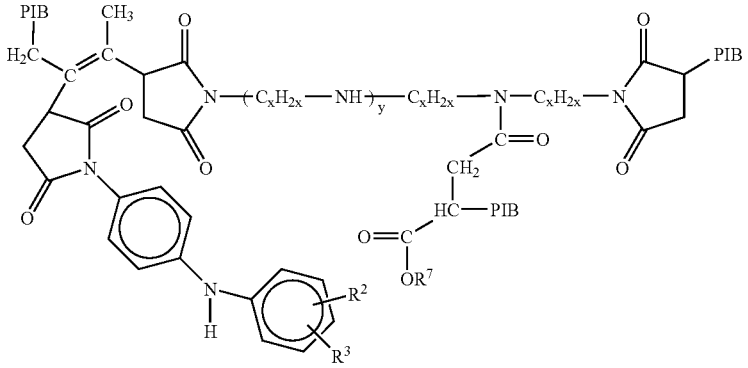

wherein PIB, x, y, $R^2$, $R^3$, and $R^7$ are as defined above, and (h) bis-succinimide-amides containing an intramolecular-cyclized or intermolecular cross-linked amide-amine of the structure:

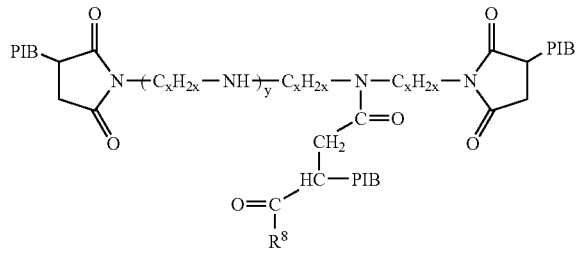

wherein $R^8$ is bonded to a secondary nitrogen atom in a polyamine of a succinimide.

In an embodiment of the present invention, the general reaction can be run as follows:

The hydrocarbyl (PIB) acylating agent is heated and stirred between 70 and 170° C. under an inert atmosphere. An amine mixture and or solution, prepared by adding the amino substituted aryl amine to a substantially linear polyamine, is added to the reaction vessel under an inert atmosphere. The reaction mixture is heated and stirred at between 70 and 170° C. for between 2-6 h. The reaction product is then diluted with process oil cooled and filtered.

EXAMPLE 1

A 3 L resin kettle equipped with overhead stirrer, Dean Stark trap and a thermocouple was charged with 954.8 of an alkenyl succinic anhydride (Acid #0.60 meq KOH/g), an amine mixture containing 46.2 g E-100 and 3.5 g NPPDA. The reaction mixture was heated with stirring under nitrogen at 160 C. for 4 h. The reaction mixture was diluted with 1099 g process oil and filtered to afford 1982 g of product.

EXAMPLE 2

A 3 L resin kettle equipped with overhead stirrer, Dean Stark trap and a thermocouple was charged with 1085 g of an alkenyl succinic anhydride (Acid #0.74 meq KOH/g), an amine mixture containing 70.2 g E-100 and 5.3 g NPPDA. The reaction mixture was heated with stirring under nitrogen at 160 C. for 4 h. The reaction mixture was diluted with 906 g process oil and filtered to afford 2004 g of product.

EXAMPLE 3

A 3 L resin kettle equipped with overhead stirrer, Dean Stark trap and a thermocouple was charged with 917 g of an alkenyl succinic anhydride (Acid #0.62 meq KOH/g), an amine mixture containing 30.8 g E-100 and 14.0 g NPPDA. The reaction mixture was heated with stirring under nitrogen at 160 C. for 4 h. The reaction mixture was diluted with 1064 g process oil and filtered to afford 1517 g of product.

EXAMPLE 4

A 3 L resin kettle equipped with overhead stirrer, Dean Stark trap and a thermocouple was charged with 1085 g of an alkenyl succinic anhydride (Acid #0.74 meq KOH/g), an amine mixture containing 58.5 g E-100 and 13.3 g NPPDA. The reaction mixture was heated with stirring under nitrogen at 160 C. for 4 h. The reaction mixture was diluted with 895 g process oil and filtered to afford 1933 g of product.

Improved compositions for use as additives in fuels and lubricants may be made with the amination product containing one or more of the foregoing compositions. A particularly preferred additive contains at least one compound selected from the group consisting of bis-succinimide-di-amides, olefin-substituted bis-succinimides, and olefin-substituted bis-succinimide-amides as shown above. Such compositions include, but are not limited to, dispersants, detergents, VI improvers and the like. For lubricant compositions, the amination product preferably has a number average molecular weight ranging from about 300 to about 5000. For fuel applications, the amination product preferably has a number average molecular weight as determined by gel permeation chromatography ranging from about 100 to about 1000.

Additives for fuels and lubricants containing the amination product as described herein may be used alone, or preferably, in combination with other conventional lubricant and fuel additive components such as friction modifiers, seal swell agents, antiwear agents, extreme pressure agents, antioxidants, foam inhibitors, lubricity agents, rust inhibitors, corrosion inhibitors, demulsifiers, viscosity improvers, dyes, and the like. Various of these components are well known to those skilled in the art and are preferably used in conventional amounts with the additives and compositions described herein.

For example, suitable friction modifiers are described in U.S. Pat. Nos. 5,344,579; 5,372,735; and 5,441,656. Seal swell agents are described, for example, in U.S. Pat. Nos. 3,974,081 and 4,029,587. Antiwear and/or extreme pressure agents are disclosed in U.S. Pat. Nos. 4,857,214; 5,242,613; and 6,096,691. Suitable antioxidants are described in U.S. Pat. Nos. 5,559,265; 6,001,786; 6,096,695; and 6,599,865. Foam inhibitors suitable for compositions and additives described herein are set forth in U.S. Pat. Nos. 3,235,498; 3,235,499; and 3,235,502. Suitable rust or corrosion inhibitors are described in U.S. Pat. Nos. 2,765,289; 2,749,311; 2,760,933; 2,850,453; 2,910,439; 3,663,561; 3,862,798; and 3,840,549. Suitable viscosity index improvers and processes for making them are taught in, for example, U.S. Pat. Nos. 4,732,942; 4,863,623; 5,075,383; 5,112,508; 5,238,588; and 6,107,257. Suitable, multi-functional viscosity index improvers are taught in U.S. Pat. Nos. 4,092,255; 4,170,561; 4,146,489; 4,715,975; 4,769,043; 4,810,754; 5,294,354; 5,523,008; 5,663,126; and 5,814,586; and 6,187,721. Suitable demulsifiers are described in U.S. Pat. Nos. 4,444,654 and 4,614,593.

Base oils suitable for use in formulating the compositions, additives and concentrates described herein may be selected from any of the synthetic or natural oils or mixtures thereof. The synthetic base oils include alkyl esters of dicarboxylic acids, polyglycols and alcohols, poly-alpha-olefins, including polybutenes, alkyl benzenes, organic esters of phosphoric acids, and polysilicone oils. Natural base oils include mineral lubrication oils which may vary widely as to their crude source, e.g., as to whether they are paraffinic, naphthenic, or mixed paraffinic-naphthenic. The base oil typically has a viscosity of about 2.5 to about 30 cSt and preferably about 2.5 to about 15 cSt at 100° C.

Accordingly, the base oil used which may be used may be selected from any of the base oils in Groups I-V as specified in the American Petroleum Institute (API) Base Oil Interchangeability Guidelines. Such base oil groups are as follows:

| Base Oil Group[1] | Sulfur (wt. %) | | Saturates (wt. %) | Viscosity Index |
|---|---|---|---|---|
| Group I | >0.03 | and/or | <90 | 80 to 120 |
| Group II | ≦0.03 | And | ≧90 | 80 to 120 |
| Group II | ≦0.03 | And | ≧90 | ≧120 |
| Group IV | all polyalphaolefins (PAOs) | | | |
| Group V | all others not included in Groups I-IV | | | |

[1]Groups I-III are mineral oil base stocks.

Additives used in formulating the compositions described herein can be blended into the base oil individually or in various sub-combinations. However, it is preferable to blend all of the components concurrently using an additive concentrate (i.e., additives plus a diluent, such as a hydrocarbon solvent). The use of an additive concentrate takes advantage of the mutual compatibility afforded by the combination of ingredients when in the form of an additive concentrate. Also, the use of a concentrate reduces blending time and lessens the possibility of blending errors.

Dispersant compositions were made according to the foregoing procedure wherein the aliphatic polyamine was a heavy polyamine, ethyleneamine E-100, from Huntsman Chemical Company of Houston, Tex., and the aromatic polyamine was N-phenyl-1,4-phenylenediamine (NPPDA). Ethyleneamine E-100 is a mixture of tetraethylenepentamine (TEPA), pentaethylenehexamine (PEHA), hexaethyleneheptamine (HEHA), and higher molecular weight products and has the structure:

$$H_2NCH_2CH_2(NHCH_2CH_2)_x\ NH_2$$

wherein x is an integer of 3, 4, 5, or higher. The amine mixture was reacted with polyisobutylene succinic anhydride (PIBSA) having a SA/PIB ratio of 1.6:1 or 1.2:1.

In the following table, the sludge containing properties of a lubricant containing the dispersant example #2 as described above, and a commercially available dispersant were compared in an industry dispersant sludge test, Sequence VG engine test to determine the average engine sludge (AES). The lubricants used were fully formulated lubricants. In each sample, the ingredients of the lubricant are exactly the same except for the dispersant.

The Sequence VG engine sludge and varnish deposit test is a fired engine-dynamometer test that evaluates the ability of a lubricant to minimize the formation of sludge and varnish deposits. The test is a replacement for the Sequence VE test (ASTM D 5302). The test method was a cyclic test, with a total running duration of 216 hours, consisting of 54 cycles of 4 hours each. The test engine was a Ford 4.6 L, spark ignition, four stroke, eight cylinder "V" configuration engine. Features of this engine include dual overhead camshafts, a cross-flow fast burn cylinder head design, two valves per cylinder, and electronic port fuel injection. A 90-minute break-in schedule was conducted prior to each test, since a new engine build is used for each test. Upon test completion, the engine was disassembled and rated for sludge. Average engine sludge was calculated for each sample.

| Sample No. | Dispersant component | Average Engine Sludge Rating (AES) |
|---|---|---|
| 1 | Amination product Sample #2 | 9.57 |
| 2 | HiTEC ® 1932 dispersant | 8.07 |

In the foregoing table, the amination product of Example #2 (Lubricant sample No. 1) gave superior sludge rating results compared to a conventional dispersant HiTEC® 1932 (Lubricant Sample No. 2), available from Ethyl Corporation, of Richmond, Va. The dispersant made according to the disclosure exhibited about a 33% increase in sludge rating over the conventional dispersant. The Sample #1 lubricant exhibited superior properties compared to a lubricant containing a dispersant made in the absence of an aromatic amine.

One embodiment is directed to a method of lubricating moving parts of a vehicle, wherein the method includes using as the crankcase lubricating oil for the internal combustion engine a lubricating oil containing a dispersant, or VI improver made with an amination product as described herein. The dispersant or VI improver is present in an amount sufficient to reduce the wear in an internal combustion engine operated using the crankcase lubricating oil, as compared to the wear in the engine operated in the same manner and using the same crankcase lubricating oil, except that the oil is devoid of the dispersant or VI improver. Accordingly, for reducing wear, the dispersant or VI improver is typically present in the lubricating oil in an amount of from 0.1 to 3 weight percent based on the total weight of the oil. Representative of the types of wear that may be reduced using the compositions described herein include cam wear and lifter wear. In other embodiments, lubricant compositions described herein may be used or formulated as gear oil, hydraulic oils, automatic transmission fluids, and the like.

Another embodiment is directed to a method for increasing soot and sludge dispersancy in a diesel engine. The method includes providing a diesel fuel containing as a detergent. The detergent includes an amination product made according to the disclosure. A fuel containing such detergent when used in a diesel engine is sufficient to increase the soot and sludge dispersancy of the fuel as compared to a fuel devoid of a detergent made with the amination product. Also provided herein is a method of fueling a vehicle's engine comprising combusting in said engine a fuel comprising a minor amount of a fuel additive as defined herein. In fuel compositions according to one embodiment of the present invention, an additive comprising the amination product presented herein can be present in the fuel in an amount of from 0.1 wt. % to about 15 wt. %.

It is contemplated that the amination product may be mixed with conventional polyamines during a reaction to make detergents, dispersants and VI improvers. Such detergents, dispersants, and VI improvers made with treated and untreated polyamines should also exhibit improved characteristics as described herein. Likewise, it is contemplated that all or a portion of a conventional detergent, dispersant or VI improver may be replace with a detergent, dispersant or VI improver made with the amination product.

At numerous places throughout this specification, reference has been made to a number of U.S. Patents. All such cited documents are expressly incorporated in full into this disclosure as if fully set forth herein.

The foregoing embodiments are susceptible to considerable variation in its practice. Accordingly, the embodiments are not intended to be limited to the specific exemplifications set forth hereinabove. Rather, the foregoing embodiments are within the spirit and scope of the appended claims, including the equivalents thereof available as a matter of law.

The patentees do not intend to dedicate any disclosed embodiments to the public, and to the extent any disclosed modifications or alterations may not literally fall within the scope of the claims, they are considered to be part hereof under the doctrine of equivalents.

What is claimed is:

1. An oil-soluble composition comprising a compound selected from the group consisting of bis-succinimide-di-amide-amines of the structure:

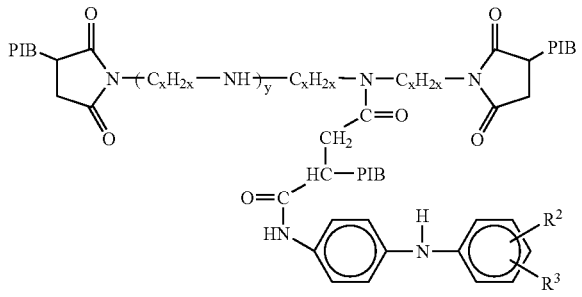

wherein PIB is polyisobutylene, x is an integer from 1 to 6, y is an integer from 1 to 10, $R^2$ is selected from the group consisting of —$NH_2$, —$NH(CH_2)_n)_mNH_2$, —$CH_2$—$(CH_2CH_2)_n$— $NH_2$, and -aryl-$NH_2$, in which n and m have a value of from 1 to 10, and $R^3$ is selected from the group consisting of —H, alkyl, alkenyl, alkoxy, arylalkyl, and alkaryl having 4 to 24 carbon atoms and with the proviso that only one of $R^2$ and $R^3$ has a terminal $NH_2$ group; bis-succinimides containing an imide-amine substituted olefin of the structure:

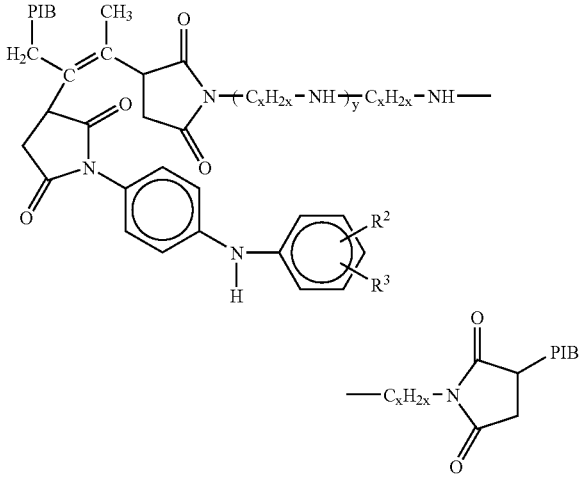

wherein PIB, x, y, $R^2$, and $R^3$ are as defined above and bis-succinimide-amides containing an imide-amine substituted olefin of the structure:

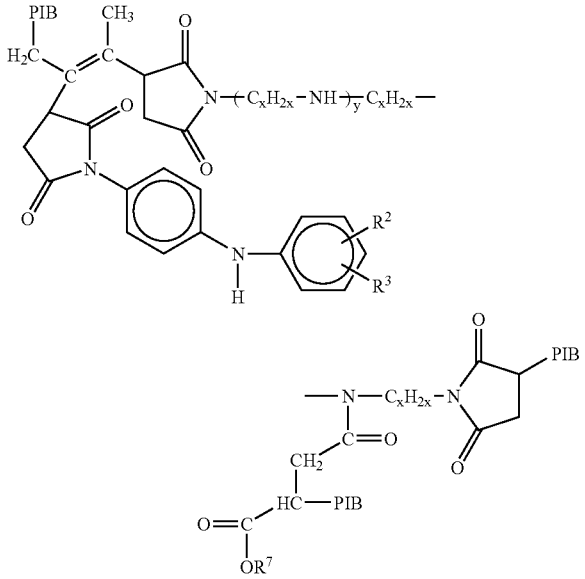

wherein PIB, x, y, $R^2$, and $R^3$ are as defined above, and $R^7$ is selected from the group consisting of H, amine salt, and a metal salt.

2. An oil-soluble composition comprising a bis-succinimide-amide containing an intramolecular-cyclized or intermolecular cross-linked amide-amine containing a structure represented by:

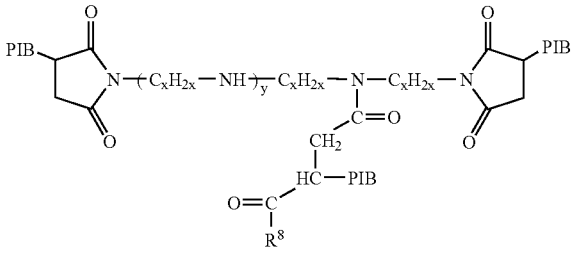

wherein $R^8$ is bonded to a secondary nitrogen atom in a polyamine of a bis-succinimide.

3. A lubricant additive containing the composition of claim 1.

4. A lubricant containing the lubricant additive of claim 2.

5. A fuel additive containing the composition of claim 1.

6. A fuel containing the fuel additive of claim 4.

* * * * *